US006840213B2

(12) United States Patent
Takahashi et al.

(10) Patent No.: US 6,840,213 B2
(45) Date of Patent: Jan. 11, 2005

(54) CONTROL APPARATUS, CONTROL METHOD AND ENGINE CONTROL UNIT FOR VARIABLE CYLINDER INTERNAL COMBUSTION ENGINE

(75) Inventors: Shunji Takahashi, Saitama-ken (JP); Hiroki Yoshimatsu, Saitama-ken (JP); Toshiaki Ichouda, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/836,346

(22) Filed: May 3, 2004

(65) Prior Publication Data

US 2004/0221832 A1 Nov. 11, 2004

(30) Foreign Application Priority Data

May 9, 2003 (JP) ..... 2003/131450

(51) Int. Cl.[7] ..... F02M 3/06; F02D 13/06

(52) U.S. Cl. ..... 123/325; 123/90.15; 123/339.15; 123/479; 123/481; 123/339.17; 123/339.18

(58) Field of Search ..... 123/90.15–90.18, 123/324, 325, 479, 481, 339.15, 339.17, 339.18

(56) References Cited

U.S. PATENT DOCUMENTS 4,484,553 A * 11/1984 Kobayashi et al. .... 123/339.15
5,481,461 A * 1/1996 Miyamoto et al. ..... 123/481
5,775,291 A * 7/1998 Choi ..... 123/339.15
6,435,147 B1 * 8/2002 Eichenseher et al. ..... 123/479
6,691,021 B2 * 2/2004 Takagi et al. ..... 123/690
2001/0003971 A1 * 6/2001 Hori et al. ..... 123/481

* cited by examiner

*Primary Examiner*—Erick Solis
(74) *Attorney, Agent, or Firm*—Arent Fox, PLLC.

(57) ABSTRACT

A control apparatus, a control method, and an engine control unit for a variable cylinder internal combustion engine are provided for appropriately performing any of an idling rotational speed control, a deceleration fuel-cut control, and an auxiliary machinery driving control irrespective of whether or not a cylinder pausing mechanism fails. The control apparatus for the variable cylinder internal combustion engine switchably operated in a full cylinder operation mode and a partial cylinder operation mode comprises an ECU. The ECU determines whether or not the cylinder pause mechanism fails, and sets a target idling rotational speed for use in the idling rotational speed control to a normal operation value when the cylinder pausing mechanism is normal and to a faulty operation value higher than the normal operation value when the cylinder pausing mechanism is faulty.

9 Claims, 3 Drawing Sheets

CONTROL APPARATUS, CONTROL METHOD AND ENGINE CONTROL UNIT FOR VARIABLE CYLINDER INTERNAL COMBUSTION ENGINE

BACKGROUND OF THE INVENTION

1. Field of the Invention:

The present invention relates to a control apparatus, a control method, and an engine control unit for a variable cylinder internal combustion engine which can be operated either in a full cylinder operation mode for operating all of a plurality of cylinders or in a partial cylinder operation mode for pausing some of the plurality of cylinders using a cylinder pausing mechanism, and more particularly, to such a control apparatus, a control method, and an engine control unit for controlling an idling rotational speed, deceleration fail cut, and driving of an auxiliary engine.

2. Description of the Prior Art:

Conventionally, Laid-open Japanese Patent Application No. 2002-221055, for example, describes a controller for a variable cylinder internal combustion engine. The variable cylinder internal combustion engine described therein is a V-type six-cylinder one which comprises a cylinder pausing mechanism for switching one half of the cylinders, i.e., three variable cylinders between an operation mode and a pause mode. In the variable cylinder internal combustion engine, the controller controls the cylinder pausing mechanism and injectors to switch valve actuating mechanisms associated with the three variable cylinders from the operation mode to the pause mode, thereby switching the three variable cylinders from the operation mode to the pause mode. Simultaneously, a fuel injected into the three variable cylinders is stopped, thereby switching the three variable cylinders from the operation mode to the pause mode. On the other hand, an operation reverse to the foregoing results in the three variable cylinders being switched from the pause mode to the operation mode. Stated another way, the variable cylinder internal combustion engine is operated either in a full cylinder operation mode in which all of the six cylinders are driven, or in a partial cylinder operation mode in which the three variable cylinders are made inoperative.

The controller conducts the switching control for switching the engine from the partial cylinder operation mode to the full cylinder operation mode by operating the valve actuating mechanisms for the three variable cylinders, while suspending the injection of the fuel to the three variable cylinders, determining whether or not a valve actuating system including the valve actuating mechanisms are normally operating in accordance with a subsequent detection signal from a LAF sensor, and stopping the subsequent injection of the fuel to the three variable cylinders upon determination of a fault in the valve actuating system for the three variable cylinders. In other words, the operation of the three variable cylinders is stopped.

The conventional controller described above has the disadvantage of low controllability and inability to appropriately control the variable cylinder internal combustion engine under a variety of operating conditions because the controller does not perform particular control operations other than that for stopping the injection of the fuel into the three variable cylinders, i.e., for stopping the operation of the three variable cylinders when the controller determines a fault in the valve actuating system for the three variable cylinders. For example, assume that the controller is designed to conduct a rotational speed control during an idling operation (hereinafter called the "idling rotational speed control") If a fault in the valve actuating system results in the number of operable cylinders reduced to three, resulting lower combustion energy of the internal combustion engine as a whole makes it difficult to continue the idling operation while overcoming a load such as friction of the variable cylinder internal combustion engine, possibly causing in the variable cylinder internal combustion engine to stop. Likewise, during the deceleration fuel cut operation for stopping the supply of a fuel to cylinders for decelerating the vehicle, or in an auxiliary machinery control for an air conditioner and the like, a fault as mentioned above would prevent the variable cylinder internal combustion engine from continuing the operation, while overcoming the load, for the same reason, possibly causing the variable cylinder internal combustion engine to stop.

SUMMARY OF THE INVENTION

The present invention has been made to solve the problems mentioned above, and it is an object of the invention to provide a control apparatus, a control method and an engine control unit for a variable cylinder internal combustion engine which are capable of appropriately accomplishing the idling rotational speed control, deceleration fuel-cut control, and auxiliary machinery driving control, irrespective of whether the cylinder pausing mechanism is normal or faulty.

According to a first aspect of the present invention, there is provided a control apparatus for controlling a variable cylinder internal combustion engine to converge the rotational speed during an idling operation of the engine to a target idling operation, wherein the variable cylinder internal combustion engine is switchably operated in a full cylinder operation mode for operating all of a plurality of cylinders and in a partial cylinder operation mode for pausing some of the plurality of cylinders by a cylinder pausing mechanism. The controller is characterized by comprising fault determining means for determining whether or not the cylinder pausing mechanism fails; and target idling rotational speed setting means for setting the target idling rotational speed to a normal operation value when the fault determining means determines that the cylinder pausing mechanism is normal, and for setting the target idling rotational speed to a faulty operation value when the fault determining means determines that the cylinder pausing mechanism is faulty.

According to this control apparatus for a variable cylinder internal combustion engine, the target idling rotational speed is set to the normal operation value when the cylinder pausing mechanism is determined to be normal, and is set to the faulty operation value different from the normal operation value when the cylinder pausing mechanism is determined to be faulty. Therefore, for example, in a configuration in which the rotational speed during an idling operation is controlled (hereinafter called the "idling rotational speed control") in the full cylinder operation mode, even if the engine cannot be switched from the partial cylinder operation mode to the full cylinder operation mode due to a fault of the cylinder pausing mechanism, the faulty operation value for the target idling rotational speed can be set higher than the normal operation value to compensate for reduced combustion energy resulting from a smaller number of operable cylinders during the idling rotational speed control, thereby, unlike before, making it possible to appropriately continue the idling operation while resisting against loading on the engine 3 such as friction. Conversely, in a configuration in which the idling rotational speed is controlled in the partial cylinder operation mode, even if the engine cannot be switched from the partial cylinder operation mode to the full cylinder operation mode due to a fault of the cylinder pausing mechanism, the faulty operation value for the target idling rotational speed can be set lower than the normal operation value to perform the idling operation while suppressing vibrations of the variable cylinder internal combustion engine during the idling operation. In the foregoing manner, the idling rotational speed can be appropriately controlled irrespective of whether the cylinder pausing mechanism is normal or faulty.

To achieve the above object, according to a second aspect of the present invention, there is provided a control method for controlling a variable cylinder internal combustion engine to converge the rotational speed during an idling operation of the engine to a target idling operation, wherein the variable cylinder internal combustion engine is switchably operated in a full cylinder operation mode for operating all of a plurality of cylinders and in a partial cylinder operation mode for pausing some of the plurality of cylinders by a cylinder pausing mechanism. The method is characterized by comprising the steps of determining whether or not the cylinder pausing mechanism fails; and setting the target idling rotational speed to a normal operation value when the determining step determines that the cylinder pausing mechanism is normal, and setting the target idling rotational speed to a faulty operation value when the determining step determines that the cylinder pausing mechanism is faulty.

This control method provides the same advantageous effects as described above concerning the control apparatus according to the first aspect of the invention.

To achieve the above object, according to a third aspect of the present invention, there is provided an engine control unit including a control program for causing a computer to control a variable cylinder internal combustion engine to converge the rotational speed during an idling operation of the engine to a target idling operation, wherein the variable cylinder internal combustion engine is switchably operated in a full cylinder operation mode for operating all of a plurality of cylinders and in a partial cylinder operation mode for pausing some of the plurality of cylinders by a cylinder pausing mechanism. The control program causes the computer to determine whether or not the cylinder pausing mechanism fails; and set the target idling rotational speed to a normal operation value when the cylinder pausing mechanism is determined to be normal, and set the target idling rotational speed to a faulty operation value when the cylinder pausing mechanism is determined to be faulty.

This engine control unit provides the same advantageous effects as described above concerning the control apparatus according to the first aspect of the invention.

To achieve the above object, according to a fourth aspect of the present invention, there is provided a controller for conducting a deceleration fuel-cut control for a variable cylinder internal combustion engine having a plurality of cylinders to stop supplying a fuel to the plurality of cylinders of the internal combustion engine when the internal combustion engine is rotating at a predetermined fuel-cut rotational speed or higher during deceleration, wherein the variable cylinder internal combustion engine is switchably operated in a full cylinder operation mode for operating all of a plurality of cylinders and in a partial cylinder operation mode for pausing some of the plurality of cylinders by a cylinder pausing mechanism. The controller is characterized by comprising fault determining means for determining whether or not the cylinder pausing mechanism fails; and fuel-cut rotational speed setting means for setting the predetermined fuel-cut rotational speed to a normal operation value when the fault determining means determines that the cylinder pausing mechanism is normal, and for setting the predetermined fuel-cut rotational speed to a faulty operation value different from the normal operation value when the fault determining means determines that the cylinder pausing mechanism is faulty:

According to this control apparatus for a variable cylinder internal combustion engine, the predetermined fuel-cut rotational speed for defining the condition for conducting the deceleration fuel-cut control is set to the normal operation value when the cylinder pausing mechanism is determined to be normal, and set to the faulty operation value different from the normal operation value when the cylinder pausing mechanism is determined to be faulty. Therefore, in a configuration in which the deceleration fuel-cut control is performed in the full cylinder operation mode, even if the engine cannot be switched from the partial cylinder operation mode to the full cylinder operation mode due to a fault of the cylinder pausing mechanism, the faulty operation value for the fuel-cut rotational speed can be set higher than the normal operation value to compensate for reduced combustion energy resulting from a smaller number of operable cylinders during the deceleration fuel-cut control, thereby, unlike before, making it possible to appropriately continue the deceleration fuel-cut operation while resisting against loading on the engine 3 such as friction. Conversely, in a configuration in which the deceleration fuel-cut control is conducted in the partial cylinder operation mode, even if the engine cannot be switched from the partial cylinder operation mode to the full cylinder operation mode due to a fault of the cylinder pausing mechanism, the faulty operation value for the target fuel-cut rotational speed can be set lower than the normal operation value to expand a rotational speed range in which the deceleration fuel-cut control. In the foregoing manner, the deceleration fuel-cut control can be appropriately conducted irrespective of whether the cylinder pausing mechanism is normal or faulty.

To achieve the above object, according to a fifth aspect of the present invention, there is provided a control method for conducting a deceleration fuel-cut control for a variable cylinder internal combustion engine having a plurality of cylinders to stop supplying a fuel to the plurality of cylinders of the internal combustion engine when the internal combustion engine is rotating at a predetermined fuel-cut rotational speed or higher during deceleration, wherein the variable cylinder internal combustion engine is switchably operated in a full cylinder operation mode for operating all of a plurality of cylinders and in a partial cylinder operation mode for pausing some of the plurality of cylinders by a cylinder pausing mechanism. The method is characterized by comprising the steps of determining whether or not the cylinder pausing mechanism fails; and setting the predetermined fuel-cut rotational speed to a normal operation value when the determining step determines that the cylinder pausing mechanism is normal, and setting the predetermined fuel-cut rotational speed to a faulty operation value different from the normal operation value when the determining step determines that the cylinder pausing mechanism is faulty.

This control method provides the same advantageous effects as described above concerning the control apparatus according to the fourth aspect of the invention.

To achieve the above object, according to a sixth aspect of the present invention, there is provided an engine control unit including a control program for causing a computer to conduct a deceleration fuel-cut control for a variable cylinder internal combustion engine having a plurality of cylinders to stop supplying a fuel to the plurality of cylinders of the internal combustion engine when the internal combustion engine is rotating at a predetermined fuel-cut rotational speed or higher during deceleration, wherein the variable cylinder internal combustion engine is switchably operated in a full cylinder operation mode for operating all of a plurality of cylinders and in a partial cylinder operation mode for pausing some of the plurality of cylinders by a cylinder pausing mechanism. The control program causes the computer to determine whether or not the cylinder pausing mechanism fails; and set the predetermined fuel-cut rotational speed to a normal operation value when the cylinder pausing mechanism is determined to be normal, and set the predetermined fuel-cut rotational speed to a faulty operation value different from the normal operation value when the cylinder pausing mechanism is determined to be faulty.

This engine control unit provides the same advantageous effects as described above concerning the control apparatus according to the fourth aspect of the invention.

To achieve the above object, according to a seventh aspect of the present invention, there is provided a controller for a variable cylinder internal combustion engine switchably operated in a full cylinder operation mode for operating all of a plurality of cylinders and in a partial cylinder operation mode for pausing some of the plurality of cylinders by a cylinder pausing mechanism, wherein the engine has an auxiliary machinery driven thereby through an auxiliary machinery clutch. The controller is characterized by comprising fault determining means for determining whether or not the cylinder pausing mechanism fails; and control means for disconnecting the auxiliary machinery clutch when the fault determining means determines that the cylinder pausing mechanism is faulty.

According to this control apparatus for a variable cylinder internal combustion engine, the auxiliary machinery clutch is disconnected when the fault determining means determines that the cylinder pausing mechanism is faulty, to break the transmission of the power from the internal combustion engine to the auxiliary machine. Therefore, for example, in a configuration in which the driving of the auxiliary machinery is controlled in the full cylinder operation mode, even if the engine cannot be switched from the partial cylinder operation mode to the full cylinder operation mode due to a fault of the cylinder pausing mechanism, the loading is reduced by breaking the transmission of the power to the auxiliary machinery, thereby making it possible to avoid the variable cylinder internal combustion engine from stopping. Thus, the auxiliary machinery can be driven under appropriate control irrespective of whether the cylinder pausing mechanism is normal or faulty.

To achieve the above object, according to an eighth aspect of the present invention, there is provided a control method for a variable cylinder internal combustion engine switchably operated in a full cylinder operation mode for operating all of a plurality of cylinders and in a partial cylinder operation mode for pausing some of the plurality of cylinders by a cylinder pausing mechanism, wherein the engine has an auxiliary machinery driven thereby through an auxiliary machinery clutch. The method is characterized by comprising the steps of determining whether or not the cylinder pausing mechanism fails; and disconnecting the auxiliary machinery clutch when the determining step determines that the cylinder pausing mechanism is faulty.

This control method provides the same advantageous effects as described above concerning the control apparatus according to the seventh aspect of the invention.

To achieve the above object, according to a ninth aspect of the present invention, there is provided an engine control unit including a control program for causing a computer to control a variable cylinder internal combustion engine switchably operated in a full cylinder operation mode for operating all of a plurality of cylinders and in a partial cylinder operation mode for pausing some of the plurality of cylinders by a cylinder pausing mechanism, the engine having an auxiliary machinery driven thereby through an auxiliary machinery clutch. The control program causes the computer to determine whether or not the cylinder pausing mechanism fails; and disconnect the auxiliary machinery clutch when the cylinder pausing mechanism is determined to be faulty.

This engine control unit provides the same advantageous effects as described above concerning the control apparatus according to the seventh aspect of the invention.

DETAILED DESCRIPTION OF THE EMBODIMENTS

Figure 1:
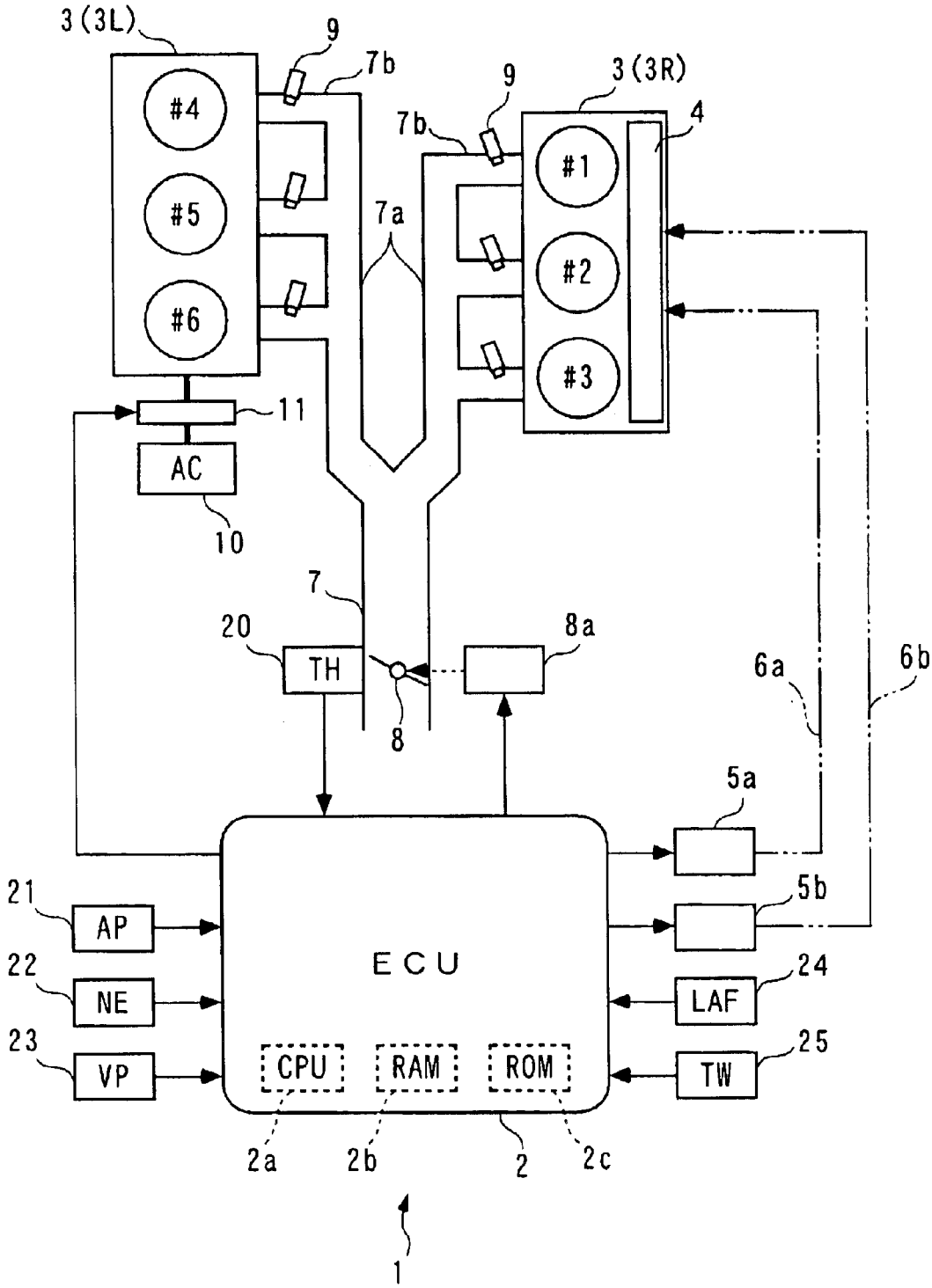
FIG. 1 is a block diagram generally illustrating a control apparatus according to one embodiment of the present invention, and a variable cylinder internal combustion engine in which the controller is embodied.

In the following, a control apparatus, a control method, and an engine control unit for a variable cylinder internal combustion engine according to one embodiment of the present invention will be described with reference to the accompanying drawings. FIG. 1 generally illustrates the configuration of a control apparatus according to one embodiment, and a variable cylinder internal combustion engine in which the control apparatus is embodied. As illustrated in FIG. 1, the control apparatus 1 comprises an engine control unit (ECU) 2 for executing an idling operation control, a deceleration fuel-cut control, an air-conditioner driving control, and the like for a variable cylinder internal combustion engine (hereinafter called the "engine") 3, as will be later described.

The engine 3 is a V-type six-cylinder DOHC gasoline engine which comprises three cylinders #1, #2, #3 on a right bank 3R, and three cylinders #4, #5, #6 on a left bank 3L. Additionally, a cylinder pausing mechanism 4 is provided on the right bank 3R.

The cylinder pausing mechanism 4 is connected to a hydraulic pump, not shown, through oil passages 6*a*, 6*b*. Electromagnetic valves 5*a*, 5*b* are disposed between the hydraulic pump and cylinder pausing mechanism 4 for an intake valve and an exhaust valve, respectively. Both of the electromagnetic valves 5*a*, 5*b* are normally closed and electrically connected to the ECU 2, such that they open the oil passages 6*a*, 6*b*, respectively, when they are turned on in response to associated driving signals from the ECU 2. During a partial cylinder operation mode, both the electromagnetic valves 5*a*, 5*b* are turned on to open the oil passages 6*a*, 6*b* to supply the cylinder pausing mechanism 4 with an oil pressure from the hydraulic pump. In this way, the cylinder pausing mechanism 4 releases couplings between the intake valve and an intake cam and between the exhaust valve and an exhaust cam (neither of which is shown in FIG. 1) in each of the cylinders #1–#3 in the right bank 3R, thereby bringing the intake valve and exhaust valve into a pausing state (closed state).

On the other hand, in a full cylinder operation mode, reverse to the foregoing, both the electromagnetic valves 5*a*, 5*b* are turned off to close the oil passages 6*a*, 6*b*, thereby blocking an oil pressure supplied from the hydraulic pump to the cylinder pausing mechanism 4. In this way, the cylinder pausing mechanism 4 couples between the intake valve and intake cam and between the exhaust valve and exhaust cam, thereby making the intake valve and exhaust valve operable. Specifically, the cylinder pausing mechanism 44 as described above has the structure similar to that illustrated, for example, in Laid-open Japanese Patent Application No. 2001-90564.

A throttle valve 8 is disposed halfway in an intake pipe 7 of the engine 3. An actuator 8*a* is coupled to the throttle valve 8, and is also electrically connected to the ECU 2. The ECU 2 controls the opening of the throttle valve 8 through the actuator 8*a* for controlling the idling rotational speed and the like, later described.

A throttle valve opening sensor 20 is also attached to the intake pipe 7. The throttle valve opening sensor 20 detects the opening TH of the throttle valve 8 (hereinafter called the "throttle valve opening TH"), and applies the ECU 2 with a signal indicative of the detected opening TH.

The intake pipe 7 is connected to the six cylinders #1–#6, respectively, through an intake manifold 7*a*. At each branch 7*b* of the intake manifold 7*a*, an injector 9 is attached opposite to an intake pipe, not shown, associated with each cylinder. These injectors 9 are driven in response to a driving signal from the ECU 2 during the full cylinder operation mode of the engine 3 to inject the fuel into the branches 7*b*. In the partial cylinder operation mode, on the other hand, the fuel is not injected into the three injectors 9 associated with the right bank 3R under the control of the ECU 2.

The engine 3 is further provided with an air conditioner (labeled "AC" in FIG. 1) 10 which represents an auxiliary machinery. The air conditioner 10 has an air compressor, not shown, coupled to a crank shaft, not shown, of the engine 3 through an air-conditioner clutch 11. The air-conditioner clutch 11 (more generally, auxiliary machinery clutch) is connected or disconnected in response to a driving signal from the ECU 2 to transmit or break the torque of the engine to the air conditioner 10.

The ECU 2 is connected to an accelerator opening sensor 21; an engine rotational speed sensor 22; a vehicle speed sensor 23; a LAF sensor 24; and a water temperature sensor 25. These accelerator opening sensor 21, engine rotational speed sensor 22, and vehicle speed sensor 23 detect the amount AP of treading on an accelerator pedal (not shown) of a vehicle (not shown) equipped with the engine 3 (hereinafter called the "accelerator opening"), an engine rotational speed NE (rotational speed), and a vehicle speed VP, respectively, and apply the ECU 2 with respective signals indicative of the detected amount AP, engine rotational speed NE, and vehicle speed VP, respectively.

The LAF sensor 24 is mounted on an exhaust pipe, not shown, for linearly detecting the concentration of oxygen in exhaust gases flowing through the exhaust pipe to apply the ECU 2 with a signal which is proportional to the detected oxygen concentration. The water temperature sensor 25, which is comprised of a thermistor or the like, detects an engine water temperature TW which is the temperature of a cooling water that circulates within a cylinder block of the engine 3, and applies the ECU 2 with a signal indicative of the detected engine water temperature TW.

The ECU 2 is based on a microcomputer which comprises an I/O interface (not shown), a CPU 2*a*, a RAM 2*b*, a ROM 2*c*, and the like. In this embodiment, the ECU 2 implements fault determining means, target idling rotational speed setting means, fuel-cut rotational speed setting means, and control means.

The ECU 2 determines a particular operating condition of the engine 3 in response to the detection signals from a variety of sensors 20–25 mentioned above, and executes a control parameter setting routine, a routine for determining a fault in the cylinder pausing mechanism 4, an idling rotational speed control mode, a deceleration fuel-cut control mode, an air-conditioner driving control mode, and the like in accordance with a control program previously stored in the ROM 2*c* and data stored in the RAM 2*b*, as will be later described.

Figure 2:
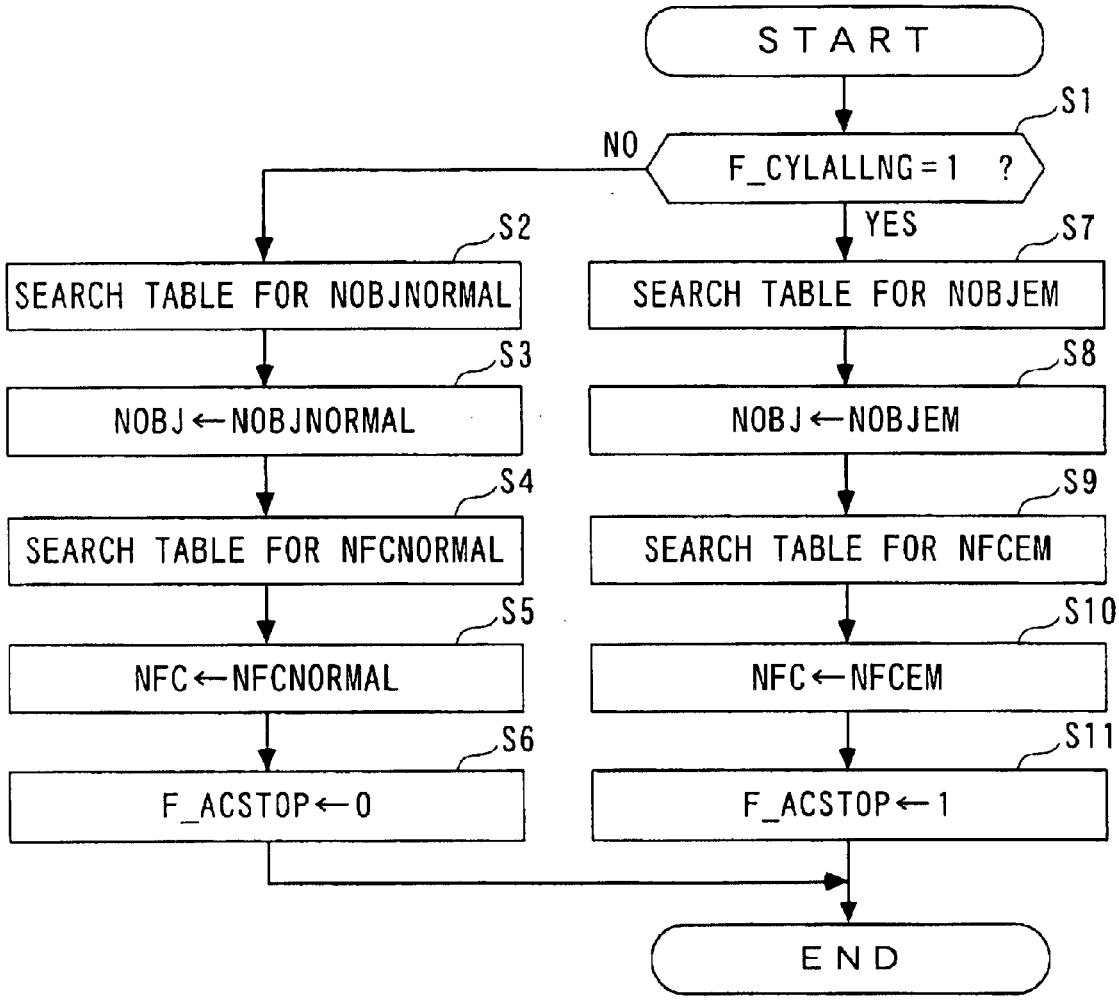
FIG. 2 is a flow chart illustrating a routine for setting control parameters.

Referring next to FIG. 2, description will be made on a routine for setting a variety of control programs for use in a variety of control modes listed above. This routine is executed at predetermined intervals.

In the control parameter setting routine, the CPU 2 first determines at step 1 (abbreviated as "S1" in FIG. 2. The same is applied to the subsequent figures) whether or not a full cylinder return fault flag F_CYLALLNG is "1." The full cylinder return fault flag F_CYLALLNG represents whether or not the cylinder pausing mechanism 4 fails so that the engine 3 cannot be returned to the full cylinder operation mode from the partial cylinder operation mode. Specifically, in a fault determination routine at step 20 in FIG. 3, the full cylinder return fault flag F_CYLALLNG is set in the following manner, as is done by an approach described in Laid-open Japanese Patent Application No. 2002-221055.

Figure 3:
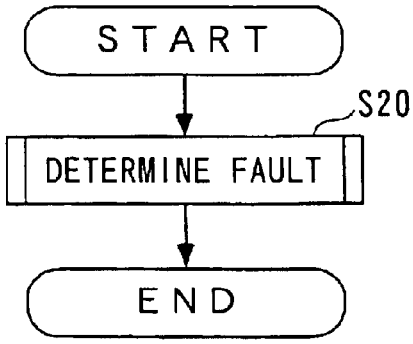
FIG. 3 is a flow chart illustrating a routine for determining a fault.

Specifically, referring to FIG. 3, the fault determining routine involves driving the cylinder pausing mechanism 4 to switch the cylinders #1–#3 of the right bank 3R from the pause mode to the operation mode. In this switching control, the valve actuating mechanism associated with the three cylinders is operated while stopping the injection of the fuel into the three cylinders #1–#3, and the fault determining routine determines in accordance with a subsequent detection signal from the LAF sensor 24 whether or not the valve actuating system including the valve actuating mechanism is normally operating. Upon determination of a fault in the valve actuating system associated with the three variable cylinders, the full cylinder return fault flag F_CYLALLNG is set to "1" for indicating the fault. Upon determination of a normal operation, the full cylinder return fault flag F_CYLALLNG is set to "0" for indicating the normal operation.

Turning back to FIG. 2, the routine proceeds to step 2 when the result of the determination at step 1 is NO indicating that the cylinder pausing mechanism 4 is normal. At step 2, the ECU 2 searches a table, not shown, in the ROM 2*c* in accordance with the engine water temperature TW for a normal operation value NOBJNORMAL for a target idling rotational speed. In this table, the normal operation value NOBJNORMAL is set to a higher value as the engine water temperature TW is lower when the engine water temperature TW is within a warm-up operation temperature range (for example, below 80° C.) for the engine 3, and is set at a predetermined value lower than the values within the warm-up operation temperature range when the engine water temperature TW is higher than the warm-up operation temperature range (for example, after a warm-up operation has been completed). Next, the routine proceeds to step 3, where the ECU 2 sets a target idling rotational speed NOBJ for use in the idling rotational speed control to the normal operation value NOBJNORMAL retrieved at step 2.

Next, at step 4, the ECU 2 searches a table, not shown, in the ROM 2*c* in accordance with the engine water temperature TW for a normal operation value NFCNORMAL for the fuel-cut rotational speed. In this table, the normal value NFCNORMAL for the fuel-cut rotational speed is set to a higher value as the engine water temperature TW is lower when the engine water temperature TW is within the warm-up operation temperature range (for example, below 80° C.) for the engine 3, and set at a predetermined value (for example, 900 rpm) lower than values within the warm-up operation temperature range when the engine water temperature TW is higher than the warm-up operation temperature range. In the table used at step 4, the normal value NFCNORMAL of the fuel-cut rotational speed is set at a value higher than the normal operation value NOBJNORMAL for the target idle rotational speed value. Next, at step 5, the ECU 2 sets a fuel-cut rotational speed NFC for use in the deceleration fuel-cut control to the normal operation value NFCNORMAL retrieved at step 4. Then, the routine proceeds to step 6, where the ECU 2 sets an air-conditioner stop flag F_ACSTOP to "0," followed by termination of the fault determination routine.

On the other hand, if the result of the determination at step 1 is YES, indicating that the engine cannot return from the partial cylinder operation mode to the full cylinder operation mode due to a fault in the cylinder pausing mechanism 4, the routine proceeds to step 7, where the ECU 2 searches a table, not shown, in the ROM 2*c* in accordance with the engine water temperature TW for a faulty operation value NOBJEM for the target idling rotational speed. In this table, the faulty operation value NOBJEM for the target idling rotational speed is set to a higher value as the engine water temperature TW is lower when the engine water temperature TW is within the warm-up operation temperature range (for example, below 80° C.) for the engine 3, and set at a predetermined value (for example, 800 rpm) lower than values in the warm-up operation temperature range when the engine water temperature TW is higher than the warm-up operation temperature range. In addition, in the table used at step 7, the fault value NOBJEM for the target idling rotational speed is set at a value higher than the aforementioned normal operation value NOBJNORMAL for the target idling rotational speed. Next, the routine proceeds to step 8, where the ECU 2 sets the target idling rotational speed NOBJ to the faulty operation value NOBJEM retrieved at step 7.

Next, the routine proceeds to step 9, where the ECU 2 searches a table, not shown, in the ROM 2*c* in accordance with the engine water temperature TW for a faulty operation value NFCEM for the fuel-cut rotational speed. In this table, the faulty operation value NFCEM for the fuel-cut rotational speed is set to a higher value as the engine water temperature TW is lower when the engine water temperature TW is within the warm-up operation temperature range (for example, below 80° C.) for the engine 3, and set at a predetermined value (for example, 1,200 rmp) lower than values within the warm-up operation temperature range when the engine water temperature TW is higher than the warm-up operation temperature range. In the table used at step 9, the faulty operation value NFCEM for the fuel-cut rotational speed is higher than the faulty operation value NOBJEM for the target idling rotational speed, and higher than the normal operation value NFCNORMAL for the fuel-cut rotational speed. Next, the routine proceeds to step 10, where the ECU 2 sets the fuel-cut rotational speed NFC to the faulty operation value NFCEM retrieved at step 9. Subsequently, the routine proceeds to step 11, where the ECU 2 sets an air-conditioner stop flag F_ACSTOP to "1," followed by termination of the fault determination routine.

Figure 4:
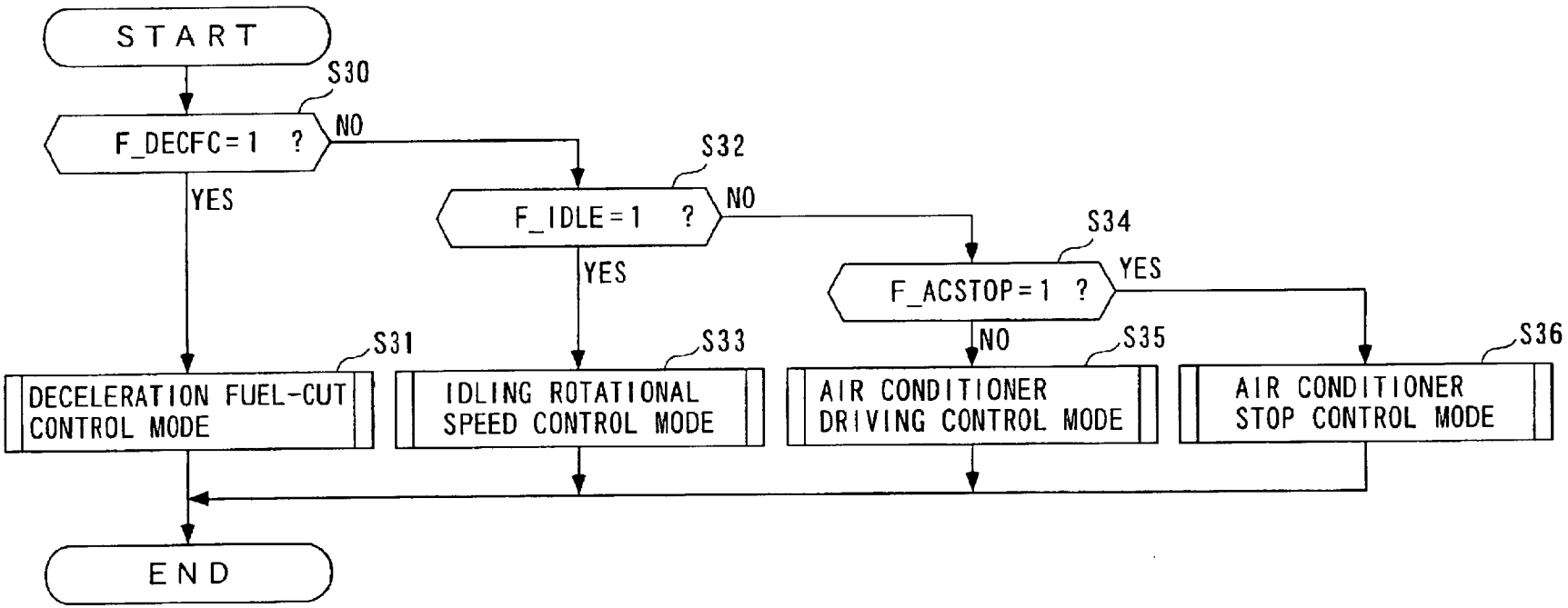
FIG. 4 is a flow chart illustrating a routine for a variety of control modes.

Next, a routine for conducting a variety of control modes mentioned above will be described with reference to FIG. 4. This routine is executed at predetermined intervals. First, in this routine, the ECU 2 determines at step 30 whether or not a deceleration fuel-cut control flag F_DECFC is "1." The deceleration fuel-cut control flag F_DECFC is set at "1" when the following deceleration fuel-cut control conditions (a), (b) are both satisfied, and to "0" when they are not satisfied:

(a) when the engine rotational speed NE is equal to or higher than the aforementioned fuel-cut rotational speed NFC; and (b) when the accelerator opening AP is at a predetermined opening (for example, zero).

If the result of the determination at step 30 is YES, indicating that the deceleration fuel-cut control conditions are both satisfied, the routine proceeds to step 31 for entering the deceleration fuel-cut control mode. In the deceleration fuel-cut control, the ECU 2 stops the injection of the fuel by the injectors 9. Then, the routine is terminated.

On the other hand, if the result of the determination at step 30 is NO, indicating that the deceleration fuel-cut control conditions are not satisfied, the routine proceeds to step 32, where the ECU 2 determines whether or not an idling control flag F_IDLE is "1." This idling control flag F_IDLE is set at "1" when an idling rotational speed control condition is satisfied (as determined based on the accelerator opening AP, engine rotational speed NE, vehicle speed VP, and the like), and to "0" when the condition is not satisfied, respectively.

If the result of the determination at step 32 is YES, indicating that the idling rotational speed control condition is satisfied, the routine proceeds to step 33 for entering the idling rotational speed control mode. Specifically, the ECU 2 controls the opening of the throttle valve 8 such that the engine rotational speed NE reaches the target idling rotational speed NOBJ. Then, the routine is terminated.

On the other hand, if the result of the determination at step 32 is NO, indicating that the idling rotational speed control condition is not satisfied, the routine proceeds to step 34, where the ECU 2 determines whether or not the aforementioned air-conditioner stop flag F_ACSTOP is "1." If the result of the determination at step 34 is NO, the routine proceeds to step 35 for entering the air-conditioner driving control mode on the assumption that the condition is satisfied for controlling the driving of the air conditioner 10. In this air-conditioner driving control mode, an air-conditioner clutch 11 is controlled to be connected or disconnected in accordance with a predetermined air conditioner operating condition (condition depending on the operating condition of the engine 3 and the state of an air-conditioner switch). Specifically, when the predetermined air-conditioner operation condition is satisfied, the air-conditioner clutch 11 is maintained in connection to drive an air compressor of the air conditioner 10 by the torque of the engine 3. Then, this routine is terminated.

On the other hand, if the result of the determination at step 34 is YES, the routine proceeds to step 36 for entering the air conditioner stop control mode on the assumption that the air conditioner 10 should be stopped. Specifically, the air conditioner clutch 11 is disconnected to break the transmission of the torque from the engine 3 to the air conditioner 10 to stop the air conditioner 10. Then, this routine is terminated.

As described above, according to the control apparatus 1 of the foregoing embodiment, if the cylinder pausing mechanism 4 fails to disable the switching from the partial cylinder operation mode to the full cylinder operation mode (when YES at step 1), the target idling rotational speed NOBJ is set at the faulty operation value NOBJEM higher than the normal operation value NOBJNORMAL. Therefore, even if the cylinder pausing mechanism 4 is in fault when the idling rotational speed control is conducted, it is possible to compensate the combustion energy for a reduction due to the smaller number of operable cylinders, thereby, unlike before, making it possible to appropriately continue the idling operation while overcoming the loading on the engine 3 such as friction. In other words, irrespective of whether the cylinder pausing mechanism 4 is normal or faulty, the control apparatus 1 can appropriately conduct the idling rotational speed control.

Also, if the cylinder pausing mechanism 4 fails to disable the switching from the partial cylinder operation mode to the full cylinder operation mode, the air-conditioner clutch 11 is disconnected to break the transmission of the torque from the engine 3 to the air conditioner 10, making it possible to reduce the loading on the engine 3, resulting from the break, to avoid the engine 3 from stopping. In other words, the controller 1 can appropriately conduct the air conditioner driving control irrespective of whether the cylinder pausing mechanism 4 is normal or faulty.

While in the foregoing embodiment, the normal operation value NOBJNORMAL and the faulty operation value NOBJEM for the target idling rotational speed NOBJ are set in accordance with the engine water temperature TW, the settings of these values NOBJNORMAL, NOBJEM are not limited to this particular way, as a matter of course. For example, the normal operation value NOBJNORMAL and faulty operation value NOBJEM may be set in accordance with any operating condition parameter other than the engine water temperature (for example, an external air temperature), or may be set at two predetermined constant values, respectively. Further alternatively, the normal operation value NOBJNORMAL may be set in accordance with an operating condition parameter such as the engine water temperature TW or the like, and may be corrected to calculate the faulty operation value NOBJEM.

While the foregoing embodiment has been described in connection with an example in which the idling rotational speed control and deceleration fuel-cut control are conducted during the full cylinder operation mode, these controls may be conducted during the partial cylinder operation mode. In this event, if the cylinder pausing mechanism 4 fails to disable the switching from the full cylinder operation mode to the partial cylinder operation mode, the faulty operation value NOBJEM for the target idling rotational speed NOBJ may be set at a value lower than the normal operation value NOBJNORMAL, and the faulty operation value NFCEM for the fuel-cut rotational speed NFC may be set to a value lower than the normal operation value NFCNORMAL. In this way, the idling operation can be performed while suppressing engine vibrations during the idling operation, and a rotational speed range can be expanded for conducting the deceleration fuel-cut control.

The auxiliary machinery associated with the variable cylinder internal combustion engine, in which the control apparatus 1 of the present invention is embodied, is not limited to the air conditioner 10 in the foregoing embodiment, but may be any device which is driven by the torque of the engine 3 through an auxiliary machinery clutch. Also, the control apparatus 1 of the present invention is not limited to the variable cylinder internal combustion engine 3 for a vehicle in the foregoing embodiment, but can be applied to a variety of variable cylinder internal combustion engines for industrial machines such as shipping and the like.

Also, the engine 3 in the foregoing embodiment represents an exemplary engine which pauses the operation of the three cylinders #1- E3 on the right bank 3R by the cylinder pausing mechanism 4 for performing the partial cylinder operation. It should be understood, however, that in a variable cylinder internal combustion engine in which the control apparatus 1 of the present invention is embodied, the number of cylinders which are paused during the partial cylinder operation mode is not limited to the example shown in the foregoing embodiment. For example, in a variable cylinder internal combustion engine having N cylinders (N is an integer), one or more and N-1 or less of cylinders may be paused.

As will be appreciated from the foregoing description, the control apparatus for a variable cylinder internal combustion engine according to the present invention can appropriately conduct any of the idling rotational speed control, deceleration fuel-cut control, and auxiliary machinery driving control irrespective of whether a cylinder pausing mechanism is normal or faulty.

What is claimed is:

1. A control apparatus for controlling a variable cylinder internal combustion engine to converge the rotational speed during an idling operation of said engine to a target idling operation, wherein said variable cylinder internal combustion engine is switchably operated in a full cylinder operation mode for operating all of a plurality of cylinders and in a partial cylinder operation mode for pausing some of the plurality of cylinders by a cylinder pausing mechanism, said apparatus comprising:

fault determining means for determining whether or not said cylinder pausing mechanism fails; and target idling rotational speed setting means for setting said target idling rotational speed to a normal operation value when said fault determining means determines that said cylinder pausing mechanism is normal, and for setting said target idling rotational speed to a faulty operation value when said fault determining means determines that said cylinder pausing mechanism is faulty.

2. A control apparatus for conducting a deceleration fuel-cut control for a variable cylinder internal combustion engine having a plurality of cylinders to stop supplying a fuel to said plurality of cylinders of said internal combustion engine when said internal combustion engine is rotating at a predetermined fuel-cut rotational speed or higher during deceleration, wherein said variable cylinder internal combustion engine is switchably operated in a full cylinder operation mode for operating all of a plurality of cylinders and in a partial cylinder operation mode for pausing some of the plurality of cylinders by a cylinder pausing mechanism, said apparatus comprising:

fault determining means for determining whether or not said cylinder pausing mechanism fails; and fuel-cut rotational speed setting means for setting said predetermined fuel-cut rotational speed to a normal operation value when said fault determining means determines that said cylinder pausing mechanism is normal, and for setting said predetermined fuel-cut rotational speed to a faulty operation value different from said normal operation value when said fault determining means determines that said cylinder pausing mechanism is faulty.

3. A control apparatus for a variable cylinder internal combustion engine switchably operated in a full cylinder operation mode for operating all of a plurality of cylinders and in a partial cylinder operation mode for pausing some of the plurality of cylinders by a cylinder pausing mechanism, said engine having an auxiliary machinery driven thereby through an auxiliary machinery clutch, said apparatus comprising:

fault determining means for determining whether or not said cylinder pausing mechanism fails; and control means for disconnecting said auxiliary machinery clutch when said fault determining means determines that said cylinder pausing mechanism is faulty.

4. A control method for controlling a variable cylinder internal combustion engine to converge the rotational speed during an idling operation of said engine to a target idling operation, wherein said variable cylinder internal combustion engine is switchably operated in a full cylinder operation mode for operating all of a plurality of cylinders and in a partial cylinder operation mode for pausing some of the plurality of cylinders by a cylinder pausing mechanism, said method comprising the steps of:

determining whether or not said cylinder pausing mechanism fails; and setting said target idling rotational speed to a normal operation value when said determining step determines that said cylinder pausing mechanism is normal, and setting said target idling rotational speed to a faulty operation value when said determining step determines that said cylinder pausing mechanism is faulty.

5. A control method for conducting a deceleration fuel-cut control for a variable cylinder internal combustion engine having a plurality of cylinders to stop supplying a fuel to said plurality of cylinders of said internal combustion engine when said internal combustion engine is rotating at a predetermined fuel-cut rotational speed or higher during deceleration, wherein said variable cylinder internal combustion engine is switchably operated in a full cylinder operation mode for operating all of a plurality of cylinders and in a partial cylinder operation mode for pausing some of the plurality of cylinders by a cylinder pausing mechanism, said method comprising the steps of:

determining whether or not said cylinder pausing mechanism fails; and setting said predetermined fuel-cut rotational speed to a normal operation value when said determining step determines that said cylinder pausing mechanism is normal, and setting said predetermined fuel-cut rotational speed to a faulty operation value different from said normal operation value when said determining step determines that said cylinder pausing mechanism is faulty.

6. A control method for a variable cylinder internal combustion engine switchably operated in a full cylinder operation mode for operating all of a plurality of cylinders and in a partial cylinder operation mode for pausing some of the plurality of cylinders by a cylinder pausing mechanism, said engine having an auxiliary machinery driven thereby through an auxiliary machinery clutch, said method comprising the steps of:

determining whether or not said cylinder pausing mechanism fails; and disconnecting said auxiliary machinery clutch when said determining step determines that said cylinder pausing mechanism is faulty.

7. An engine control unit including a control program for causing a computer to control a variable cylinder internal combustion engine to converge the rotational speed during an idling operation of said engine to a target idling operation, wherein said variable cylinder internal combustion engine is switchably operated in a full cylinder operation mode for operating all of a plurality of cylinders and in a partial cylinder operation mode for pausing some of the plurality of cylinders by a cylinder pausing mechanism, wherein:

said control program causes the computer to determine whether or not said cylinder pausing mechanism fails; and set said target idling rotational speed to a normal operation value when said cylinder pausing mechanism is determined to be normal, and set said target idling rotational speed to a faulty operation value when said cylinder pausing mechanism is determined to be faulty.

8. An engine control unit including a control program for causing a computer to conduct a deceleration fuel-cut control for a variable cylinder internal combustion engine having a plurality of cylinders to stop supplying a fuel to said plurality of cylinders of said internal combustion engine when said internal combustion engine is rotating at a predetermined fuel-cut rotational speed or higher during deceleration, wherein said variable cylinder internal combustion engine is switchably operated in a full cylinder operation mode for operating all of a plurality of cylinders and in a partial cylinder operation mode for pausing some of the plurality of cylinders by a cylinder pausing mechanism, wherein:

said control program causes the computer to determine whether or not said cylinder pausing mechanism fails; and set said predetermined fuel-cut rotational speed to a normal operation value when said cylinder pausing mechanism is determined to be normal, and set said predetermined fuel-cut rotational speed to a faulty operation value different from said normal operation value when said cylinder pausing mechanism is determined to be faulty.

9. An engine control unit including a control program for causing a computer to control a variable cylinder internal combustion engine switchably operated in a full cylinder operation mode for operating all of a plurality of cylinders and in a partial cylinder operation mode for pausing some of the plurality of cylinders by a cylinder pausing mechanism, said engine having an auxiliary machinery driven thereby through an auxiliary machinery clutch, wherein:

said control program causes the computer to determine whether or not said cylinder pausing mechinism fails; and disconnect said auxullry machinary clutch when said cylinder pausing mechanism is determined to be faulty.

* * * * *